US007713084B1

(12) United States Patent
Weeks et al.

(10) Patent No.: US 7,713,084 B1
(45) **Date of Patent: *May 11, 2010**

(54) PROTECTIVE ELECTRICAL WIRING DEVICE AND SYSTEM

(75) Inventors: Richard Weeks, Little York, NY (US); John Benoit, Montpelier, VT (US)

(73) Assignee: Pass & Seymour, Inc., Syracuse, NY (US)

( * ) Notice: Subject to any disclaimer, the term of this patent is extended or adjusted under 35 U.S.C. 154(b) by 275 days.

This patent is subject to a terminal disclaimer.

(21) Appl. No.: 11/531,812

(22) Filed: Sep. 14, 2006

Related U.S. Application Data

(63) Continuation-in-part of application No. 11/274,817, filed on Nov. 15, 2005, now Pat. No. 7,407,410, which is a continuation of application No. 10/680,797, filed on Oct. 7, 2003, now Pat. No. 6,994,585, application No. 11/531,812, and a continuation-in-part of application No. 11/032,420, filed on Jan. 10, 2005, now Pat. No. 7,189,110, which is a continuation of application No. 10/680,797, filed on Oct. 7, 2003, now Pat. No. 6,994,585.

(51) Int. Cl.
*H01R 13/60* (2006.01)

(52) U.S. Cl. ..... 439/535; 439/536; 439/620.21; 439/620.11; 174/58

(58) Field of Classification Search ..... 439/535, 439/536, 650, 352, 694, 620.21, 620.22; 174/48, 66, 67, 50, 53, 58; 220/241
See application file for complete search history.

(56) References Cited

U.S. PATENT DOCUMENTS

| | | | | |
|---|---|---|---|---|
| 3,192,499 | A * | 6/1965 | West | 439/354 |
| 3,975,075 | A * | 8/1976 | Mason | 439/107 |
| 4,273,957 | A | 6/1981 | Kolling, Jr. | |
| 4,477,141 | A | 10/1984 | Hardesty | |
| 4,725,249 | A | 2/1988 | Blackwood et al. | |
| 6,376,770 | B1 * | 4/2002 | Hyde | 174/58 |
| 6,774,307 | B2 * | 8/2004 | Kruse et al. | 174/53 |
| 7,312,394 | B1 * | 12/2007 | Weeks et al. | 439/106 |

* cited by examiner

*Primary Examiner*—Tho D Ta
(74) *Attorney, Agent, or Firm*—Daniel P. Malley; Bond, Schoeneck & King, PLLC

(57) ABSTRACT

The present invention is directed to an electrical wiring system that includes a plug device having a plurality of wires configured to be connected to an electrical distribution circuit. An electrical wiring device includes an input receptacle and at least one electrical element. The input receptacle is configured to receive the plug device to thereby establish electrically a continuous path between the at least one electrical element and the plurality of wires when the plug device is inserted into the input receptacle, the electrical wiring device including no external terminal connection elements.

41 Claims, 10 Drawing Sheets

PROTECTIVE ELECTRICAL WIRING DEVICE AND SYSTEM

CROSS-REFERENCE TO RELATED APPLICATIONS

This is a continuation-in-part application of U.S. patent application Ser. No. 11/274,817 filed on Nov. 15, 2005 now U.S. Pat. No. 7,407,410 and U.S. patent application Ser. No. 11/032,420 filed on Jan. 10, 2005, now U.S. Pat. No. 7,189,110 both of which are continuation applications of U.S. patent application Ser. No. 10/680,797 filed on Oct. 7, 2003, now U.S. Pat. No. 6,994,585 the contents of which are relied upon and incorporated herein by reference in their entirety, and the benefit of priority under 35 U.S.C. §120 is hereby claimed.

BACKGROUND OF THE INVENTION

1. Field of the Invention

The present invention relates generally to electrical circuit installation, and particularly to electrical devices that facilitate installation of electrical circuits in a building or some other structure.

2. Technical Background

Installing electrical circuits in buildings and/or other structures is typically labor intensive, time-consuming, and a process that requires electricians of various skill levels. As a result the installation process is expensive. The first phase of the installation is commonly referred to as the "rough-in" phase. In new construction, either conduit or armored cable is disposed through out the structure in accordance with the building plans. Junction boxes are installed at appropriate locations, and brackets and metal device boxes are installed throughout the structure where electrical service is desired. Junction boxes, of course, are employed to house the connection point, or junction, of several conductors. Metal device boxes are used to accommodate electrical wiring devices. For example, the types of electrical wiring devices may include, but are not limited to, receptacles, switches, dimmers, GFCIs, AFCIs, transient voltage surge suppressors (TVSS), protective devices, timer devices, sensors of various types including occupancy sensors, thermostats, lighting fixtures, and/or combinations thereof. After the boxes are placed, the electrical wires are pulled through the conduits and all of the circuits are bonded. At this point, the leads from the electrical wires extend from the boxes and are visible and accessible for the next phase of the installation process.

Before discussing the next phase of the process, it is noted that electrical cables may include two to five conductive wires. For example, in a structure that requires high power, the most common way of distributing that power is by employing the three-phase power system. As those of ordinary skill in the art recognize, five wires are employed. Three phase power includes three "hot" or "live" wires. Each of these wires transmits electrical power that is 120 degrees out of phase with the other two hot wires. The other two wires are the neutral conductor and the ground wire. Three phase power typically comes from the power utility via four wires: the three-phase wires, and the neutral. If the current flowing through each of the phases is equal, no current will flow through the neutral. The neutral wire is typically connected to the building ground at the structure's main distribution panel. The five wire cable is distributed from the central panel. Some of the circuits in the structure are designed to provide power to grounded equipment. These circuits may employ three wires, a line conductor (hot wire), a neutral conductor, and a ground. Some circuits may only employ two wires, the line conductor and the neutral conductor.

Referring back to the installation process, after the "rough-in" phase has been completed, the electrical wiring devices are terminated, i.e., they are electrically connected to the wire leads. This part of the installation process is the most costly and time consuming. A journeyman electrician must perform, or supervise, the connection of each wiring device in the structure. In this process, each electrical wire must be stripped and terminated to the device. What is needed is an efficient, labor-saving, and cost effective means for terminating the electrical wires and coupling them to the individual devices.

SUMMARY OF THE INVENTION

The present invention addresses the needs described above by providing an efficient, labor-saving, and cost effective means for terminating the electrical wires and coupling them to the individual devices. The present invention addresses the problems described above. The present invention is directed to an electrical wiring system that simplifies the installation process. Further, the present invention provides an efficient system and method for terminating electrical devices. The system and method is cost-effective because it eliminates many of the labor intensive practices that are currently in use.

One aspect of the present invention is directed to an electrical wiring system that includes a plug device having a plurality of wires configured to be connected to an electrical distribution circuit. An electrical wiring device includes an input receptacle and at least one electrical element. The input receptacle is configured to receive the plug device to thereby establish electrically a continuous path between the at least one electrical element and the plurality of wires when the plug device is inserted into the input receptacle, the electrical wiring device including no external terminal connection elements.

In another aspect, the present invention is directed to a method for installing an electrical wiring device within an electrical distribution circuit. The electrical distribution circuit includes a plurality of electrical conductors coupled to a source of electrical power. The method includes the step of providing a plug device including a plurality of conductive elements. An electrical wiring device is provided that includes an input receptacle and at least one electrical element. The input receptacle is configured to receive the plug device to thereby establish an electrically continuous path between the at least one electrical element and the plurality of conductive elements when the plug device is inserted into the input receptacle, the electrical wiring device including no external terminals. The plurality of conductive elements are connected to the plurality of electrical conductors. The plug connector is inserted into the input receptacle to establish electrical continuity between the at least one electrical element and the plurality of conductive elements.

In yet another aspect, the present invention is directed to an electrical wiring device that includes a housing and at least one electrical element disposed in the housing. An input receptacle is formed in the housing. The input receptacle is configured to receive a plug connector device including a plurality of conductive elements, a continuous electrical path being established between the at least one electrical element and the electrical distribution circuit when the plug connector device is inserted into the input receptacle. The electrical wiring device includes no external terminal connection elements.

In yet another aspect, the present invention is directed to an electrical wiring system that includes a plug device including a plurality of wires configured to be connected to an electrical distribution circuit. The plug device includes female electrical contacts substantially inaccessible to a user. An electrical wiring device includes an input receptacle and at least one electrical element. The input receptacle is configured to receive the plug device to thereby establish electrically continuous path between the at least one electrical element and the plurality of wires when the plug device is inserted into the input receptacle, the plug device being safely removable from the electrical wiring device when the system is energized.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
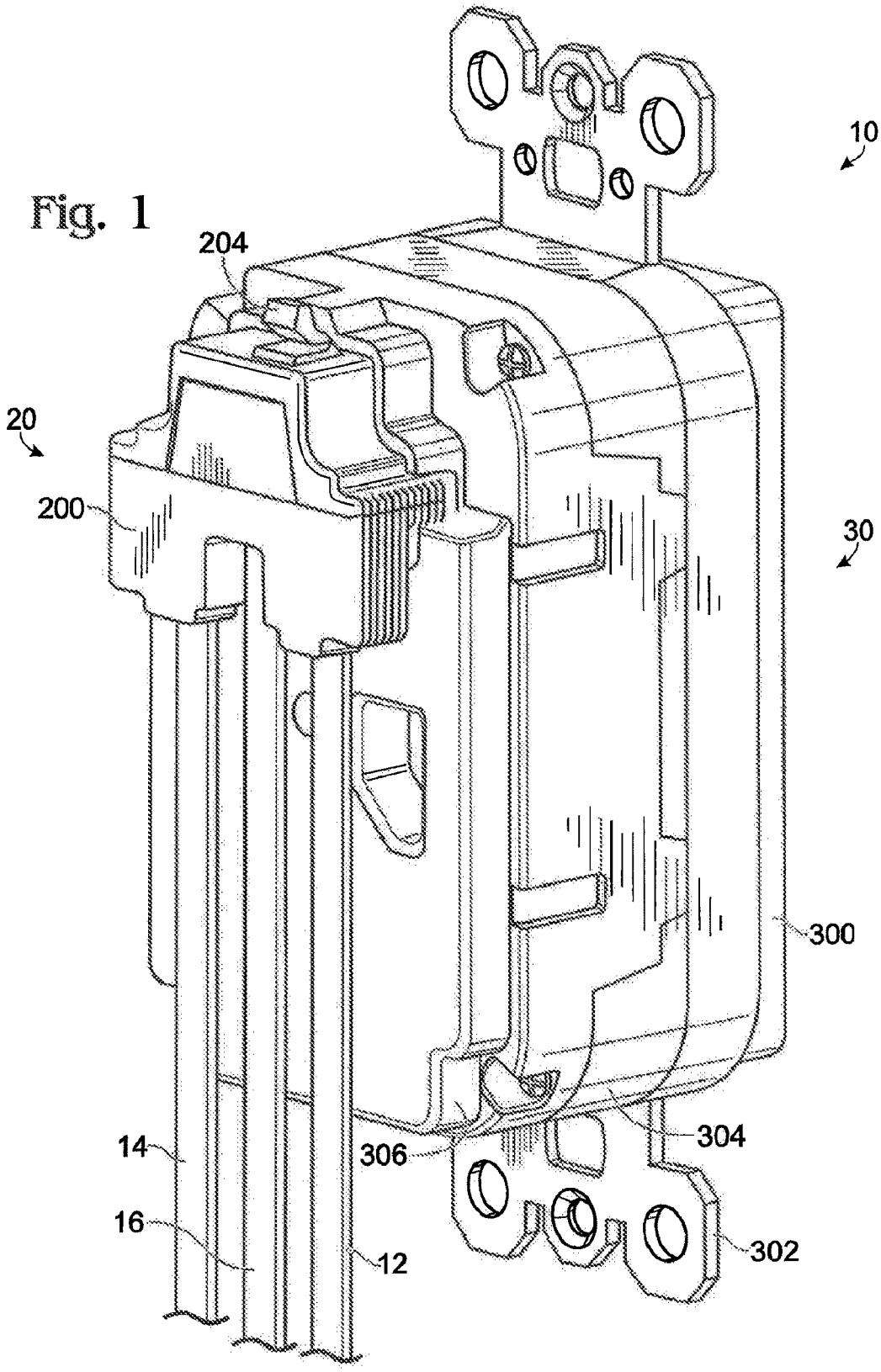
FIG. 1 is a perspective view of an electrical wiring system in accordance with a first embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the system of the present invention is shown in FIG. 1, and is designated generally throughout by reference numeral 10.

As embodied herein, and depicted in FIG. 1, a perspective view of an electrical wiring system 10 in accordance with a first embodiment of the present invention is disclosed. System 10 includes a plug connector 20 that mates with electrical wiring device 30. Electrical power conductor wires (12,14, 16) are terminated at plug 20. The present invention may be configured to accommodate 2 wire systems and three-phase (5 wire) systems, as well as the 3-wire system shown. Further, system 10 of the present invention may be adapted to a wiring system that employs more than 5 wires. When plug 20 is installed in device 30, electrical continuity is established between the plurality of wires (12,14,16) and the wiring device 30. One feature of the present invention is that it includes no external terminal connections. Power is provided to device 30 via plug connector 20. Service, depending on the nature of the device, is provided to the user via the front face.

The exterior portion of wiring device 30 includes a cover 300, a separator portion 304, and a body member 306. A strap 302 is disposed between the cover 300 and the separator 304. Body 306, separator 304 and cover 300 are injection molded components, again, using materials such as polymers, polycarbonate, or nylon materials. The contacts (3160, 3180, 3200—see FIG. 2) are fabricated using copper alloy materials They may be plated with an electrically conductive material such as a tin alloy. Strap 302 may be fabricated using polymer, polycarbonate or nylon materials, a copper alloy or plated steel. When an electrically conductive material is used, strap 302 serves to ground an electrically conductive outlet box or mounting surface to the wiring device. When an electrically non-conductive material is used, the strap may be integral to body 306, separator 304, or cover 300.

Plug 20 includes a housing 200 and connector contacts (which are disposed within body 200 and therefore not shown in the Figure). In the embodiment shown, connector contacts 202 are female contacts designed to accept male contacts disposed within wiring device 30. However, those of ordinary skill in the art will understand that system 10 may be designed the other way around, i.e., with male plug contacts and female device contacts.

In the embodiment depicted in FIG. 1, plug connector 20 features a novel 90° design. The electrical power conductors (12,14,16) enter the plug connector at an angle of approximately 90° relative to the orientation of the contacts. This feature reduces the width dimension of the plug connector, allowing installation of the device in a greater variety of wiring boxes. By way of example, an elongated wiring box, commonly referred to as "raceway" restricts the width dimension of the device to less than about 1.70 inches. In one embodiment of the present invention, the width dimension (depth behind the strap to the rearward surface of the plug connector) is 1.52 inches. The conductors (12,14,16) closely parallel the back surface of body member 306 in this embodiment.

Figure 2:
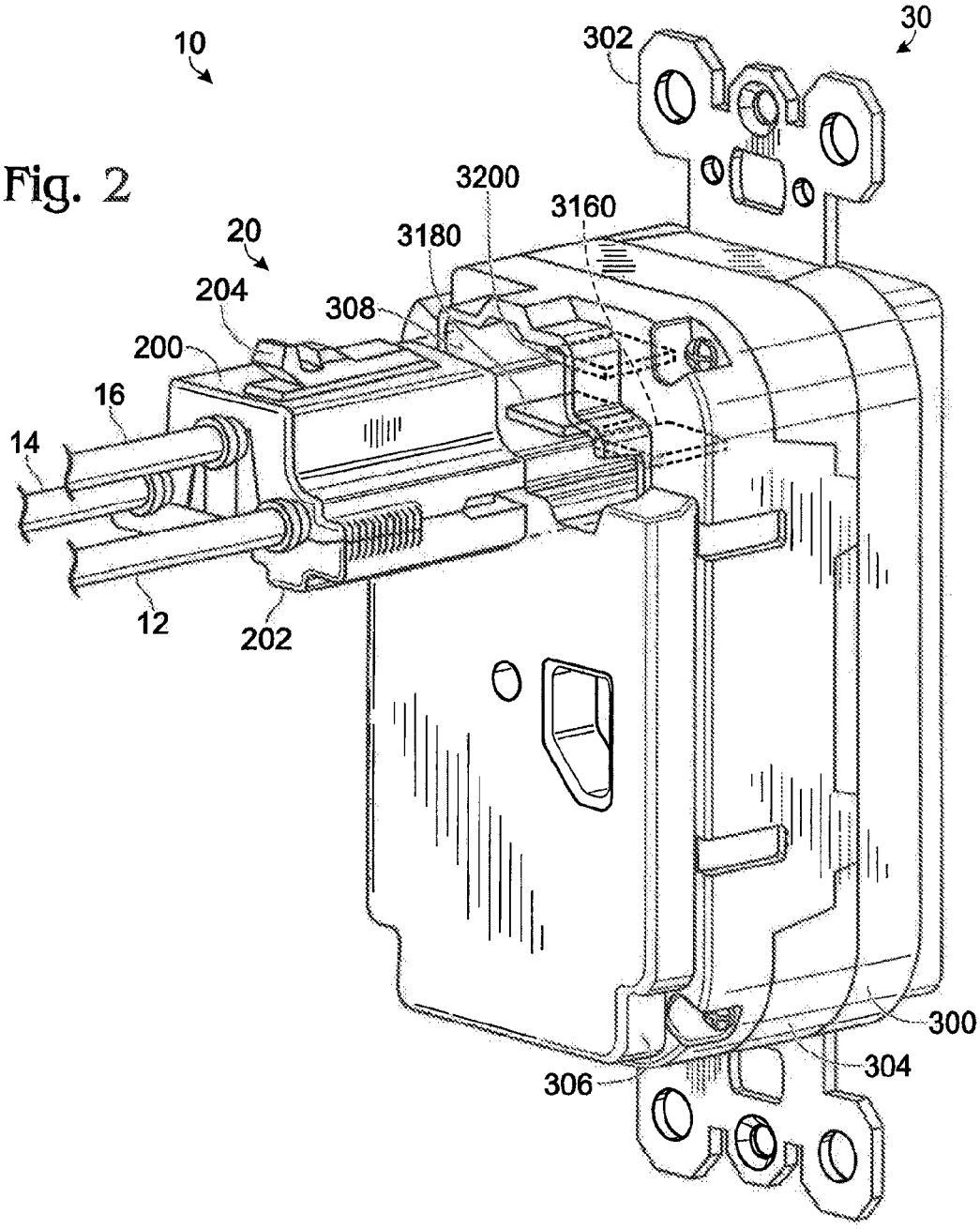
FIG. 2 is a perspective view of an electrical wiring system in accordance with a second embodiment of the present invention.

Referring to FIG. 2, a perspective view of an electrical wiring system in accordance with a second embodiment of the present invention is disclosed. In this embodiment, plug connector 20 aligns the conductors (12,14,16) with the contacts disposed therein. The wiring device 30 is identical to the device depicted in FIG. 1. FIG. 2 also provides a rear-view of wiring device 30. Body member 306 includes a rear-receptacle 308 formed therein. Receptacle 308 is shaped to accommodate plug connector 20. Receptacle 308 includes hot line receptacle blade 3160, neutral line receptacle blade 3180, and ground receptacle blade 3200. Of course, each male contact blade mates with a corresponding female contact mechanism in plug connector 20. Housing 200 includes latch mechanism 204. When plug connector 20 is inserted into receptacle 308, latch mechanism 204 prevents plug 20 from being pulled out of receptacle 308.

Latch mechanism 204 is configured to meet Underwriter's Laboratories (UL) standards for a locking connector. In this case, UL requires that a static pull test of 20 pounds be applied to the connector for one minute. During the test, plug connector 20 may not separate from receptacle 308. During operation, latch mechanism 204 flexes upon insertion of plug connector 20. The flexure latch mechanism 204 relaxes to a non-flexed position upon successful locking of plug connector 20 to receptacle 308, and emits an audible snapping sound or visual indication that locking has been achieved. Flexible latch mechanism 204 may also be configured to be accessible to the finger or to a tool when plug connector 20 is locked to receptacle 308. In this embodiment, when latch mechanism 204 is accessed and flexed manually, or by the tool, plug connector 20 can be removed from receptacle 308. The flexure is oriented in a direction opposite to the insertion direction in order to meet requirements in Underwriters Laboratories (UL) standards. In another embodiment, plug connector 20 can be locked into receptacle 308 using screws or any number of fastening means familiar to those skilled in the art.

Those of ordinary skill in the art will recognize that any suitable materials may employed in fabricating plug connector 20. In one embodiment, plug housing 200 is formed from injection molded plastic, polycarbonate, or other polymer based materials. The plug connector contacts may be fabricated using any suitable conductive material such as a copper alloy material. Plug connector housing 200 may be fabricated by coupling an upper housing to a lower housing, i.e., the upper housing is snapped onto lower housing to thereby enclose and terminate wires (12,14,16) in plug connector 20.

In one embodiment, the female electrical contacts disposed in plug connector 20 may include a wire seat portion that accommodates the wire conductor. The wire conductor (12, 14,16) is subsequently bonded to the seat portion. Each female contact also includes two exterior spring contact members and an interior spring contact member configured to hold the male contact blade therebetween. When the male receptacle contact blade (3160, 3180, 3200) are inserted, the exterior spring contact members separate from the interior spring contact member to receive and hold the male contact blade firmly therebetween. Reference is made to U.S. Pat. No. 6,994,585, which is incorporated herein by reference as though fully set forth in its entirety, for a more detailed explanation of the female contact arrangement described herein.

In an alternate embodiment of the present invention, the female contacts may be pre-disposed in either the upper portion or in the lower portion of housing 200. In this embodiment, each female contact is equipped with an insulation-displacement blade element. Of course, when the upper housing portion is snapped onto the lower housing portion, or vice-versa, the blade element cuts through and displaces the insulation on the wire (12,14,16) until electrical continuity is established between the wire (12,14,16) and the female contact. In yet another alternate embodiment of the present invention, the female contacts in plug 20 may be terminated to wire leads at the factory. The pre-terminated leads may be coupled to wires (12,14,16) using twist-on wire connectors. Reference is made to U.S. Pat. No. 6,994,585, which is incorporated herein by reference as though fully set forth in its entirety, for a more detailed explanation of the plug connector termination methods employed by the present invention.

Figure 3:
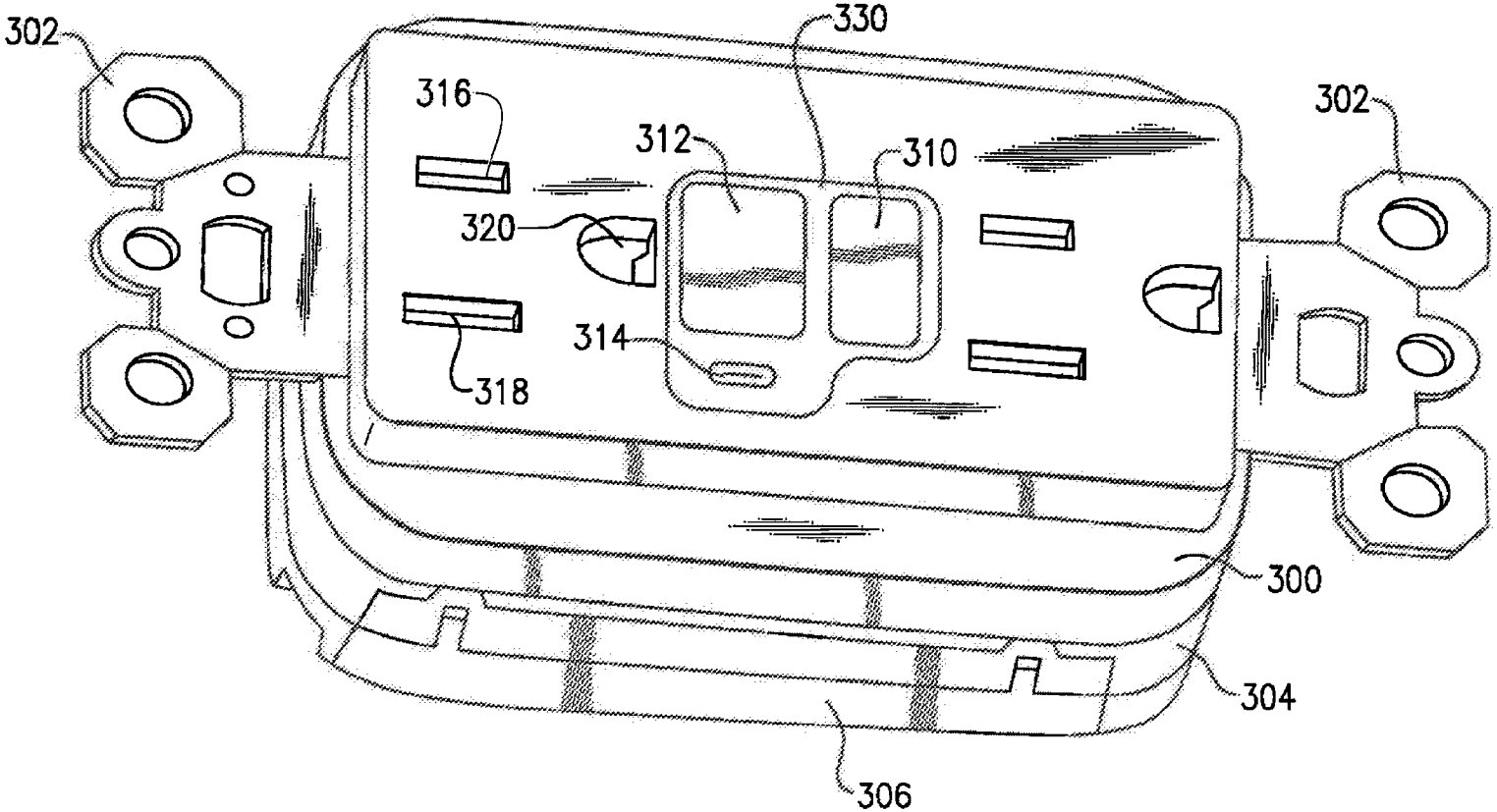
FIG. 3 is a top perspective view of the illustrating a cover member of the electrical wiring device in accordance with an embodiment of the present invention.

Referring to FIG. 3, a top perspective view of cover member 300 of the electrical wiring device 30 is disclosed. In one embodiment of the present invention, cover member 300 includes two user-accessible load receptacles, each having openings for a hot load contact 316, neutral load contact 318, and ground contact 320. An indented portion 330 is disposed in a central portion of cover 300. Indented portion 330 accommodates test button 310, reset button 312, and trip indicator 314. Trip indicator 314 is aligned with the reset button 312. When the indicator 314 is illuminated, the user is guided to the reset button 312. If the device has not reached an end-of-life condition, it will be reset when the reset button 312 is actuated, extinguishing the trip indicator light 314.

Figure 4:
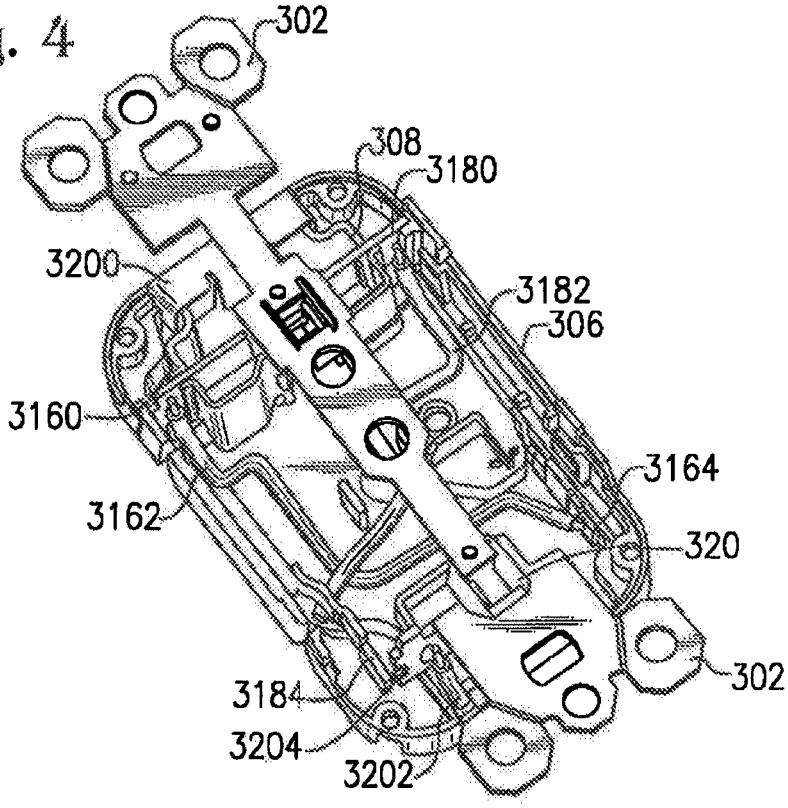
FIG. 4 is sectional view showing the rear body member of the electrical wiring device in accordance with an embodiment of the present invention.

Referring to FIG. 4, a sectional view showing the rear body member of the electrical wiring device 30 is shown. Receptacle opening 308 is disposed in one end of body member 306. The hot terminal 3164 and the neutral terminal 3184 are disposed in the other end of body member 306 on either side of ground strap 302. Receptacle opening 308 consists of a molded material that fixes the hot contact blade 3160, the neutral contact blade 3180, and the ground blade 3200 is a predetermined geometric relationship to facilitate mating with plug connector 20. The shape of molded opening 308 also conforms to the plug connector form factor.

Before any further discussion, it must be noted that the ground strap member 302 is not supported by body member 306. Strap member 302 is, in fact, inserted into separator member 304. Thus, in the view of FIG. 4, strap 302 is suspended a predetermined distance over the other components shown in the view. Strap 302 is shown in this manner to clearly illustrate the various power connections disposed in body member 306.

A hot conductor 3162 is bonded to terminal member 3164. The hot conductor 3162 extends diagonally toward hot receptacle contact blade 3160 and is bonded thereto. The hot receptacle contact blade 3160 is accessible to the rear portion of device 30 via receptacle opening 308. A neutral conductor 3182 is bonded to the neutral terminal member 3184 and extends diagonally toward neutral receptacle contact blade 3180. The neutral conductor 3182 is bonded to the neutral receptacle contact blade 3180 after it crosses over the hot conductor 3162 in the interior portion of body member 306. The neutral receptacle contact blade 3180 is accessible to the rear portion of device 30 via receptacle opening 308. The ground strap 302 includes a connection tab 3204 that is bonded to ground wire 3202. Ground wire 3202 is inserted through the separator 304 (not shown) and extends along the length of body member 306 until it is terminated at receptacle ground blade member 3200 disposed in receptacle opening 308. Ground strap 302 also includes ground contacts 320 in communication with openings disposed in cover member 300.

Figure 5:
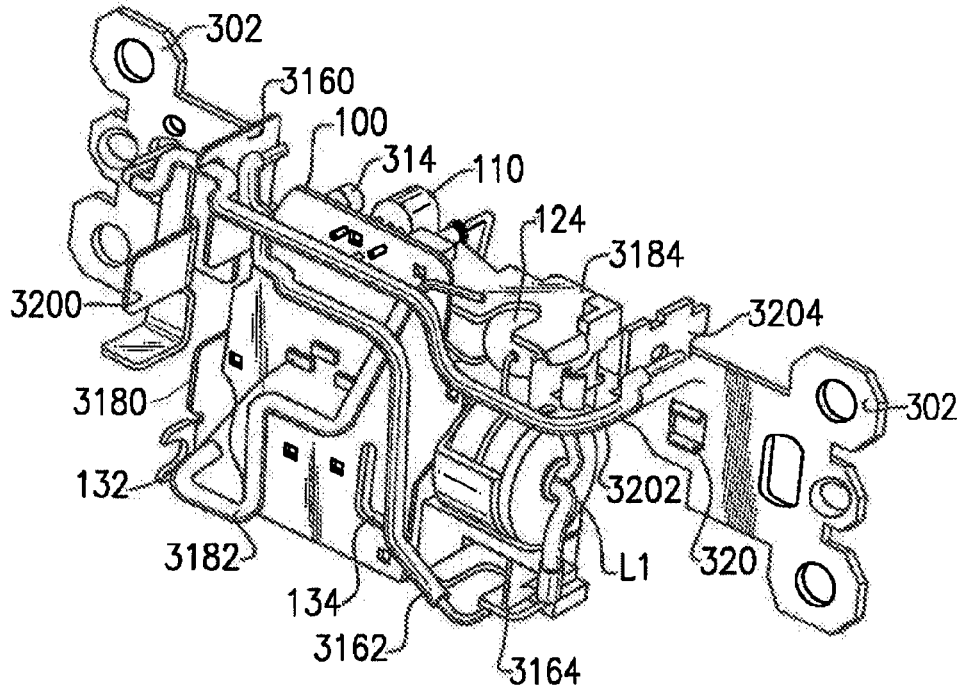
FIG. 5 is a detail view showing a rear portion of the printed circuit board assembly in accordance with an embodiment of the present invention.

FIG. 5 is a detail view showing a rear portion of the printed circuit board assembly. In particular, this view illustrates the compact spatial relationship of the ground strap 302, terminals (3164, 3184), and receptacle blades (3160, 3180, 3200) relative to PCB 100. The back side of PCB 100 includes several discrete components 132 disposed thereon. The discrete components 132 may include resistors, capacitors, semiconductors, and/or an integrated detector circuit. A cutout 134 is formed in PCB 100 as a spark gap that isolates components from other circuitry. Other components such as SCR 110, MOV 124, and LED 314 are disposed on the opposite side of PCB 100. Toroid assembly L1 is disposed adjacent to PCB 100 on a side opposite the receptacle 308. All of the components shown in FIG. 5, with the exception of ground strap 302 are disposed between body member 306 and separator member 304.

Figure 6:
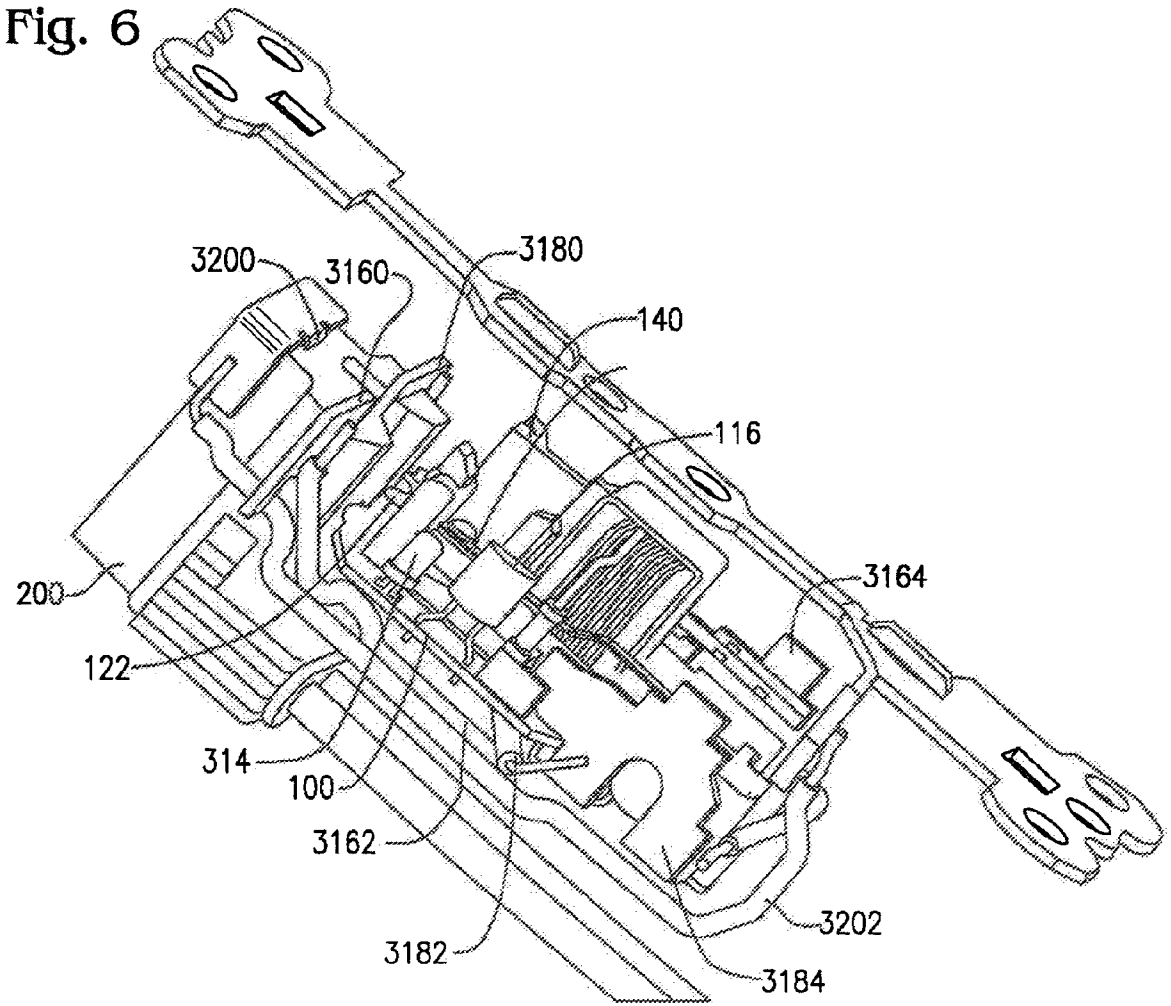
FIG. 6 is a detail side view of the printed circuit board assembly shown in FIG. 5.

FIG. 6 is a detail view showing a side view of the printed circuit board assembly depicted in FIG. 5. In this view, the back body 306, separator 304, and cover member 300 are omitted for clarity of illustration. In the discussion of FIG. 4, it was noted that strap 302 is disposed in the separator and therefore disposed a predetermined distance over the other components disposed on PCB 100. This arrangement is shown more clearly in the view provided by FIG. 6. PCB 100 includes SCR 110, solenoid 116, cantilevered interrupt structure 118, auxiliary switch mechanism 122, latch block 140 (also part of the circuit interrupter mechanism), and LED 314 disposed on one side of the PCB 100. Conductors 3162, 3182, and 3202 extend underneath PCB 100, between their respective terminal connections and their respective receptacle blade connections. At one end of PCB 100, MOV 124 and toroid assembly L1 (see FIG. 5) are nestled between hot line terminal 3164 and neutral line terminal 3184. At the far end of PCB 100, FIG. 6 shows plug connector 20 mated with the blade contacts (3160, 3180, 3200) disposed in receptacle 308.

Those of ordinary skill in the art will understand that the aforementioned components disposed on PCB 100 implement a GFCI circuit. However, the present invention may be implemented using any suitable type of device including a transient voltage surge suppressor (TVSS), an arc fault circuit interrupter (AFCI), a timer mechanism, an occupancy sensor or other type of sensor, a thermostat, a night light, or a device that includes a combination of the above. Clearly, the form factor of cover member 300 will change accordingly.

Figure 7:
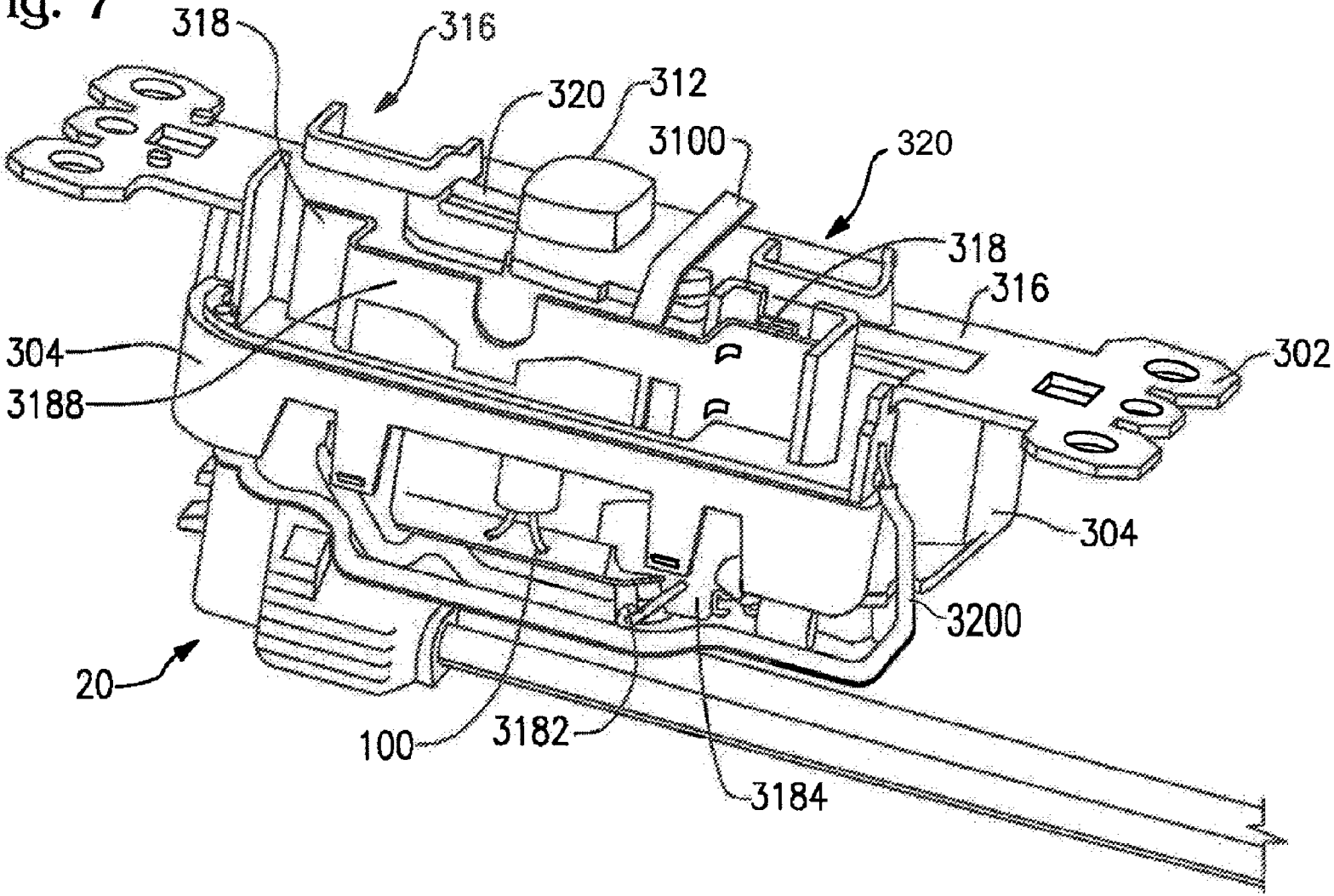
FIG. 7 is a detail side view of the printed circuit board assembly shown in FIG. 6 with the separator portion of the electrical wiring device.

FIG. 7 is a detail view illustrating the functionality of the separator portion 304. In fact, the main difference between FIG. 6 and FIG. 7 is the inclusion of separator member 304. PCB 100 has been discussed in detail above. What is of note is that separator member 304 accommodates and positions user accessible elements, such as the receptacle contact structures (318, 316), reset button 312, test switch 3100, and etc., between their respective positions on cover member 300 and their respective electrical connection with PCB 100. For example, user accessible neutral contact structure 3188 is inserted and disposed in a fixed position by separator 304 such that neutral face contacts 318 are in communication with the receptacle openings formed in cover member 300. At the same time, separator 304 ensures that electrical connectivity is established between the neutral contact structure 3188 and neutral line terminal 3184. The hot contact structure is the minor image of the neutral contact structure. Thus, any discussion thereof would be duplicative. In any event, the aforementioned arrangement ensures that AC power provided by the plug 20/receptacle 308 connection is available to the user via the cover openings.

Figure 8:
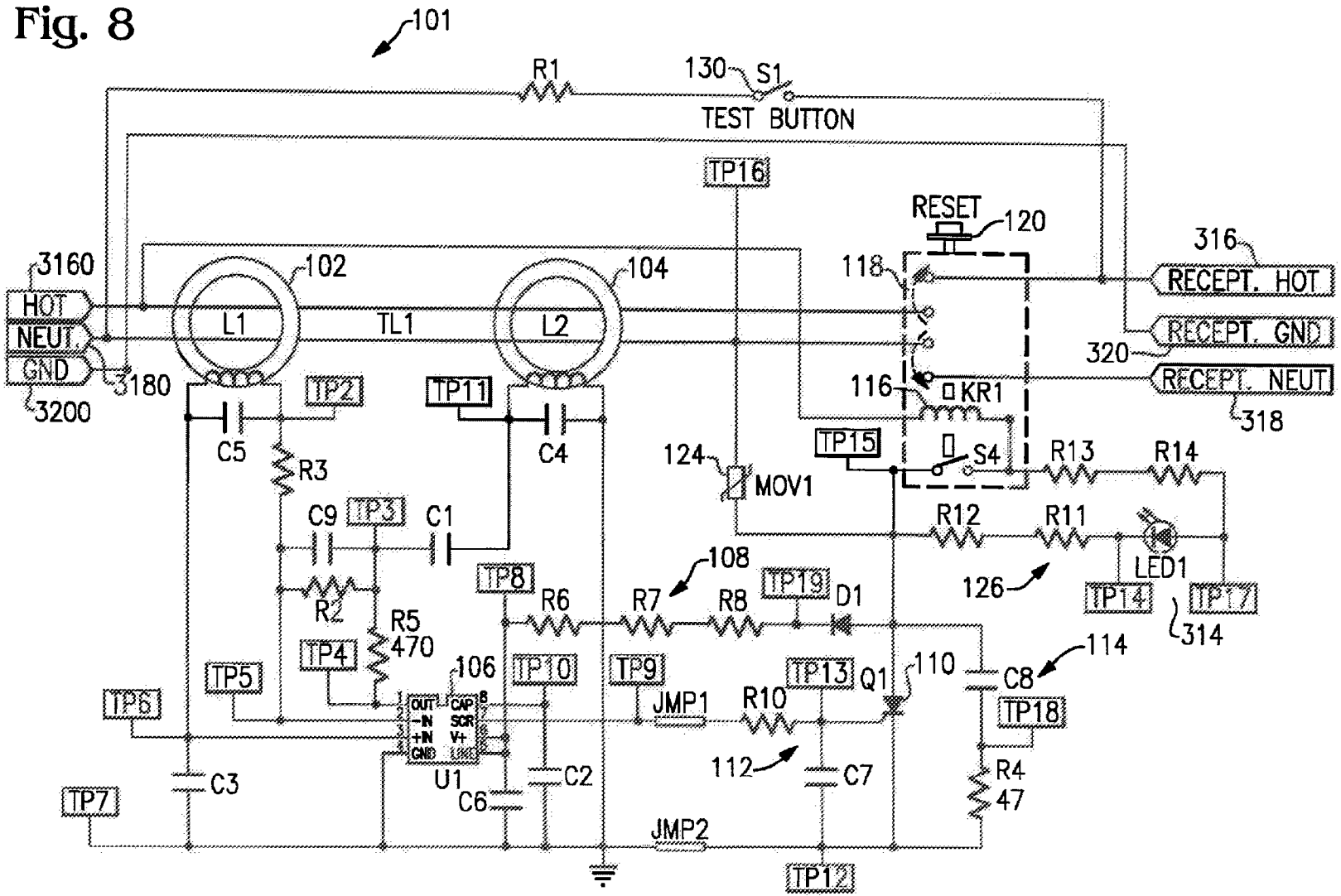
FIG. 8 is a schematic view of the protective circuit in accordance with an embodiment of the present invention.

As embodied herein and depicted in FIG. 8, a schematic view of the protective circuit employed in the electrical wiring device of the present invention is disclosed. Moving from left to right in the schematic, it is seen that GFCI 101 includes hot line receptacle blade 3160, neutral line receptacle blade 3180, and ground receptacle blade 3200. On the load side of device 10, there are a pair of user accessible receptacles, each including a hot receptacle terminal 316 and a neutral receptacle terminal 318. As noted above, there are no external terminal elements provided by device 30.

The ground fault circuitry includes a differential transformer 102 which is configured to sense load-side ground faults. Transformer 104 is configured as a grounded neutral transmitter and is employed to sense grounded-neutral fault conditions. Both transformers are disposed in toroid assembly L1. Both differential transformer 102 and grounded-neutral transformer 104 are coupled to detector integrated circuit 106. Detector 106 is powered by a power supply circuit 108 connected to pin $V^+$ on detector 106. The detector output, provided on output pin SCR, is connected to the control input of SCR 110. Filter 112, comprising resistor R10 and capacitor C7, low-pass filter the detector output signal. GFCI 101 also includes a snubber circuit 114 that includes resistor R4 and capacitor C8. Snubber circuit 114 prevents voltage transients from triggering SCR 110.

When SCR 110 is turned ON, solenoid 116 is energized, actuating circuit interrupter 118. Solenoid 116 remains energized for a time period that is typically less than about 25 milliseconds. Circuit interrupter 118 trips, resulting in the line terminals being disconnected from respective load terminals. After the fault condition has been eliminated, the circuit interrupter 118 may be reset by way of reset button 120. In one embodiment, the reset mechanism 120 is purely mechanical in nature and does not include any electrical contacts for test initiation.

It will be apparent to those of ordinary skill in the pertinent art that modifications and variations can be made to circuit interrupter of the present invention depending on contact structure implementation. For example, circuit interrupter 118 may be implemented using a cantilevered contact structure. The line terminals (3160, 3180) are electrically connected to the receptacle load terminals when the device 10 is reset. When in the tripped state, the line and receptacle contacts are disconnected from each of the other contacts.

GFCI 101 addresses certain end of life conditions by denying power to the load when the device is unable to function. As an example of an end-of-life condition, solenoid 116 is susceptible to burn-out if SCR 110 becomes shorted out, or is permanently turned ON. Solenoid 116 may burn out if it is energized for more than about 1 second. Once the solenoid 116 burns out, the circuit interrupter 118 is incapable of being tripped. Solenoid burn-out prevention is provided by auxiliary switch 122. Auxiliary switch 122 is configured to open when the circuit interrupter 118 is in the tripped position. If SCR 110 is shorted out, or permanently ON, auxiliary switch 122 ensures that solenoid 116 is not permanently connected to a current source. The user may attempt to reset the device 10 by depressing the reset button 120, but the circuit interrupter 118 will immediately trip in response to the current flowing through the solenoid 116. Because the trip mechanism 118 is coupled to the auxiliary switch 122, auxiliary switch 122 is opened before solenoid 116 burns out.

Another failure mode that is addressed by GFCI 101 relates to the end-of-life failure mode of movistor (MOV) 124. MOV 124 is disposed in series with auxiliary switch 122 and trip solenoid 116. This arrangement significantly reduces the probability of damage due to an over-current situation. When MOV 124 reaches end-of-life and shorts out, trip solenoid 116 is energized and auxiliary switch 122 is opened. As previously described, when auxiliary switch 122 opens, the flow of short circuit current is terminated before any damage to GFCI 101 ensues.

GFCI 101 also includes trip indication circuit 126. Trip indicator 126 is implemented by placing LED1 and series resistors (R11-R14) in parallel with auxiliary switch 122. LED1 is configured to emit a visual signal when circuit interrupter 118 and auxiliary switch 122 are in an open state (tripped).

GFCI 101 also includes a test circuit 128. The test circuit 128 is coupled between the line neutral terminal 3180 and the hot receptacle terminal 316. The test circuit includes a test button 130 disposed in series with test resistor R1.

Figure 9:
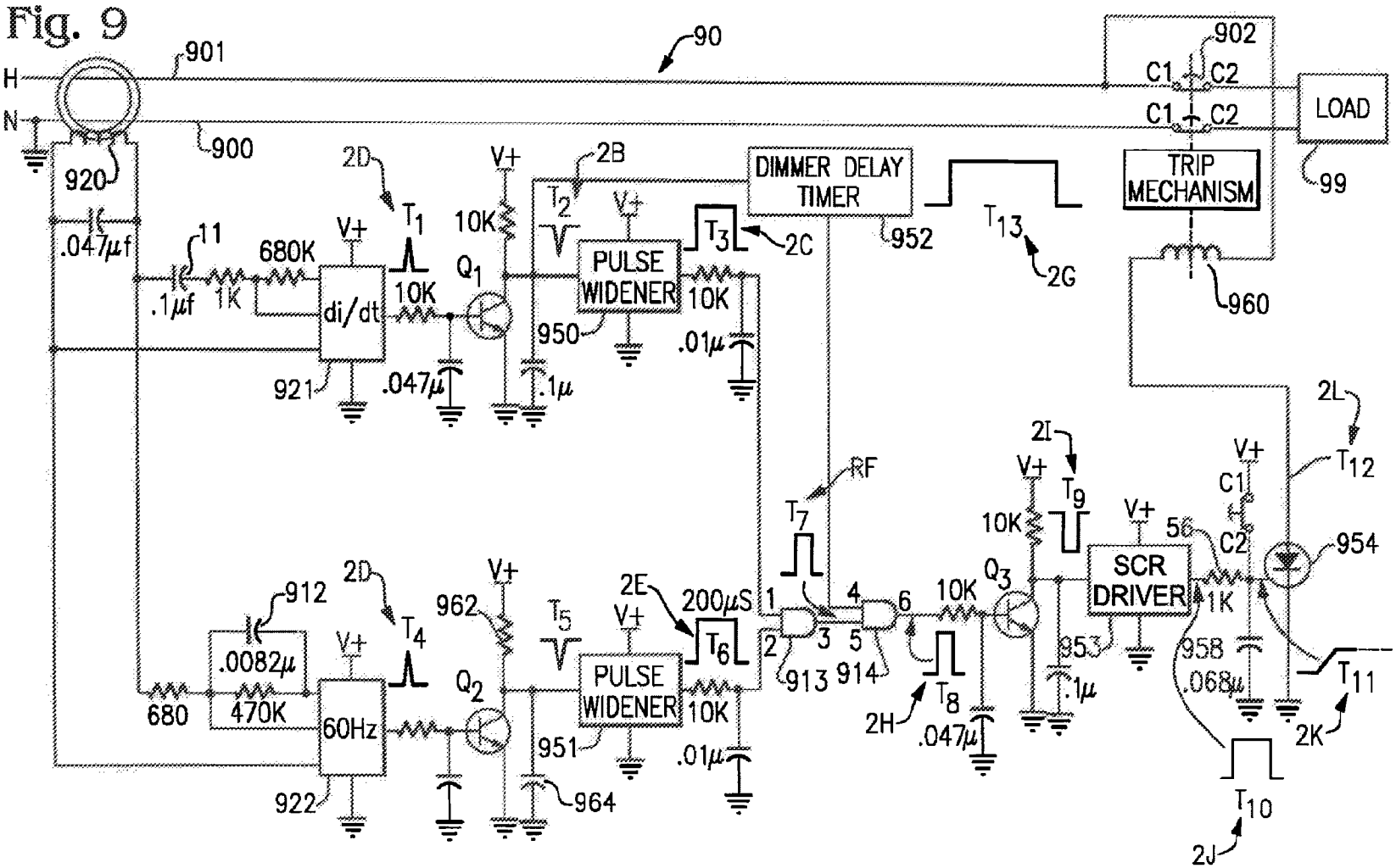
FIG. 9 is a schematic of an arc fault circuit interrupter (AFCI) in accordance with the present invention.

Referring to FIG. 9, a schematic of an arc fault circuit interrupter (AFCI) 90 in accordance with the present invention is shown. AFCI 90 is formed from components that are readily available and that can be easily integrated into an electrical receptacle. The circuit is designed so that it can be manufactured in the same form as ground fault circuit interrupter (GFCI) receptacle devices. AFCI 90 protects an electrical circuit and includes at least a neutral conductor 900 and a line conductor 901 connected to a power source (not shown). A ground conductor (not shown) is optionally present. AFCI 90 detects electrical arcs occurring between line conductor 901 and ground, neutral conductor 900 and ground should the power source be of reverse polarity, or line conductor 901 and neutral conductor 900.

A circuit interrupter 902 is connected in series with line conductor 901 between the power source and a load 99. This embodiment incorporates a first stage arc sensor 920, shown as a current transformer, which is configured to respond to the rate of change of neutral and/or line conductor current with respect to time. Sensor 920 may be designed with a physically small core of a type and number of secondary turns which gives optimum sensitivity during arcing. Either a single conductor (LINE) or both conductors can pass thru the sensor. The arc fault detector detects arcs that are either LINE to GROUND or LINE to NEUTRAL. Sensor 920 feeds two detector/amplifiers 921, 922. Detector/amplifiers 921, 922 are preferably RV4141A (Fairchild Semiconductor) low power ground fault interrupter ICs. Detector/amplifier 921, also referred to as the di/dt stage, has a high pass filter capacitor 911 on its input side, while detector/amplifier 922, also referred to as the 60 Hz or "threshold" stage, uses a low pass filter capacitor 912 in a feedback stage. The 60 Hz threshold detector 922 controls the level at which an arcing condition is to be detected, e.g., at a 75 Ampere or greater load current.

Figure 10:
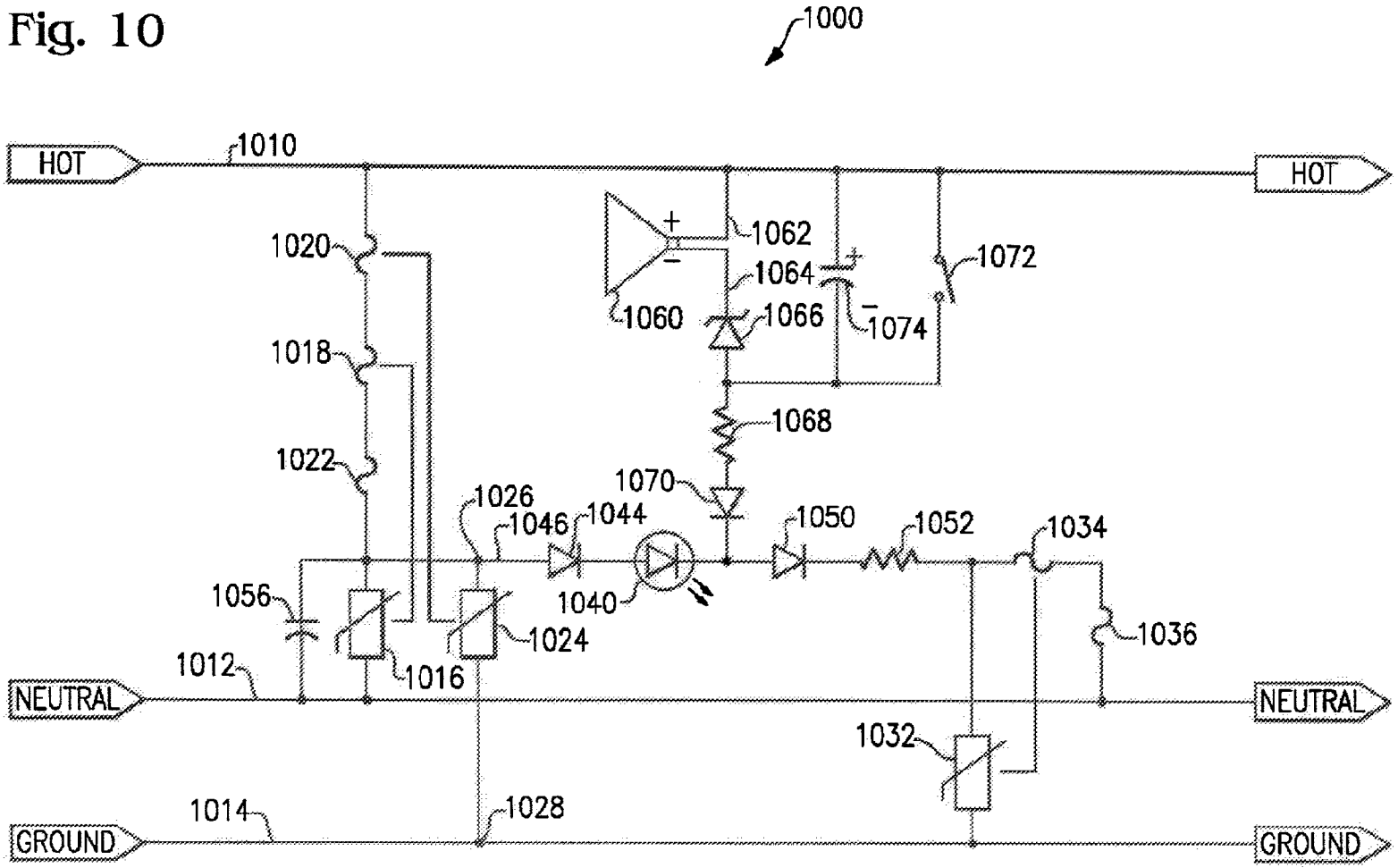
FIG. 10 is a schematic of a transient voltage surge suppressor (TVSS) in accordance with the present invention.

Referring now to FIG. 10, a schematic of a transient voltage surge suppressor (TVSS) in accordance with the present invention is shown. A TVSS, also known as a surge protective device (SPD), protects wiring or a load from overvoltages such as occur during lightning storms. TVSS 1000 is configured to protect a low voltage 120 VAC single phase electrical circuit. The circuit includes three conductors that for convenience are referred to herein as the hot 1010, neutral 1012, and ground 1014 conductors. Transient voltages are known to occur between any pair of two of these conductors, and surge suppression devices, such as metal oxide varistors, are arranged to absorb transient voltage surges between any pair of the conductors. Fuses are provided for disconnecting the surge suppression devices from the circuit in the event of failure. Two specific failure modes are provided for, over current failure and temperature failure.

A first metal oxide varistor 1016, such as a 150 volt RMS metal oxide varistor is connected in series with a first thermally responsive fuse 1018, a second thermally responsive fuse 1020, and a conventional over current fuse 1022, and the series combination is connected between the hot conductor 1010 and the neutral conductor 1012. A second varistor 1024 of the same type is connected at one end 1026 in series with three fuses just mentioned, and the other end 1028 is connected to the ground conductor. These two varistors protect the hot-neutral and hot-ground pairs. Each of the thermally responsive fuses 1018, 1020 is positioned physically close to one of the varistors 1016, 1024, so that a rise in temperature of the varistor, as would be caused by a failure, causes the adjacent fuse to open. Since the two thermally responsive fuses 1018, 1020 are connected in series, the thermal failure of either of the varistors will cause the connection of both varistors to the hot conductor to be broken. A third metal oxide varistor 1032 is connected in series with another thermal fuse 1034, and an over current fuse 1036. The combination of the third varistor 1032 and the two fuses 1034, 1036 is connected between the neutral conductor 1012 and the ground conductor 1014. A thermal failure or an impedance failure of the third varistor device 1032 will cause one of the thermal fuse 1034 or the over current fuse 1036 to open, thereby disconnecting the varistor from the neutral-ground circuit.

A visible indicator, such as a light emitting diode 1040, is connected between the hot conductor 1010 and the neutral conductor, 1012 so that the light emitting diode 1040 is illuminated when all three of the varistors 1016, 1024, 1032 are functional, more particularly when none of the fuses 1018, 1020, 1022, 1034, 1036 is blown. A half wave rectifier diode 1044 has its anode 1046 connected to the electrical conductor in series with the two thermal fuses 1018, 1020 and the over current fuse 1022, feeding the first two varistors 1016, 1024. The cathode of the rectifier diode 1044 is connected to one terminal of the light emitting diode 1040. The other terminal of the light emitting diode 1040 is connected through a blocking diode 1050 to a current limiting resistor 1052, arranged in series, and then through the third thermal fuse 1034 and third over current fuse 1036 to the neutral electrical conductor 1012. A decoupling capacitor 1056 is preferably connected between the anode of the diode 1044 and the neutral conductor 1012.

When all of the fuses 1018, 1020, 1022, 1034 and 1036 are intact, that is when no fault has occurred, a circuit is created from the hot-conductor 1010 through the rectifier diode 1044, the light emitting diode 1040, the blocking diode 1050, the current limiting resistor 1052 and thence to the neutral conductor. The light emitting diode provides visible indication. If any of the three thermal fuses 1018, 1020, 1034 or two over current fuses opens 1022, 1036, the circuit is interrupted and the light emitting diode is extinguished, alerting a fault condition.

A TVSS 1010 in accordance with this invention also provides an audible indication of a fault in either of the varistors 1016, 1024 protecting the hot-neutral circuit or the hot-ground circuit respectively. A device, such as a simple buzzer 1060 or a piezoelectric device, has one terminal 1062 connected to the hot conductor 1010, and the other terminal 1064 connected by way of the series combination of a zener diode 1066, a current limiting resistor 1068, a first blocking diode 1070, second blocking diode 1050, second current limiting resistor 1052, the thermal fuse 1034, and the over current fuse 1036 to the neutral conductor 1012. The first and second thermal fuses 1018, 1020 and the first over current fuse 1022 are connected in series with rectifier diode 1044 and the light emitting diode 1040 between the hot electrical conductor 1010 and the junction of the two blocking diodes 1070, 1050 just mentioned, so that in normal operation no significant voltage passes through the buzzer, and the buzzer remains silent. If either of the varistors 1016, 1024 bridging the hot-neutral or hot-ground fails and any of the first and second thermal fuses 1018, 1020 and the first over current fuse 1022 is opened, voltage across the buzzer 1060 will cause it to sound.

In order to allow a user to deactivate the buzzer while awaiting repair, a normally open switch 1072 is connected effectively across the combination of the buzzer 1060 and the zener diode 1066. When the switch 1070 is closed, current through the buzzer 1060 is shunted through the switch and the buzzer is silenced. A capacitor 1074 is provided across the zener/audio alarm network to provide a DC voltage component to improve the audio operating performance.

The buzzer deactivating switch 1072 is a simple normally open electrical switch, rather than a device that permanently deactivates the alarm 1060 or permanently interrupts a circuit trace. The switch 1072, once closed, can be opened at will and the buzzer 1060 reactivated. Accidentally deactivating the buzzer might destroy the audible alarm feature of the device permanently, and require its replacement even before it is installed. The use of a normally open switch in accordance with this invention eliminates this problem, and allows the alai in to be deactivated and reactivated.

Figure 11:
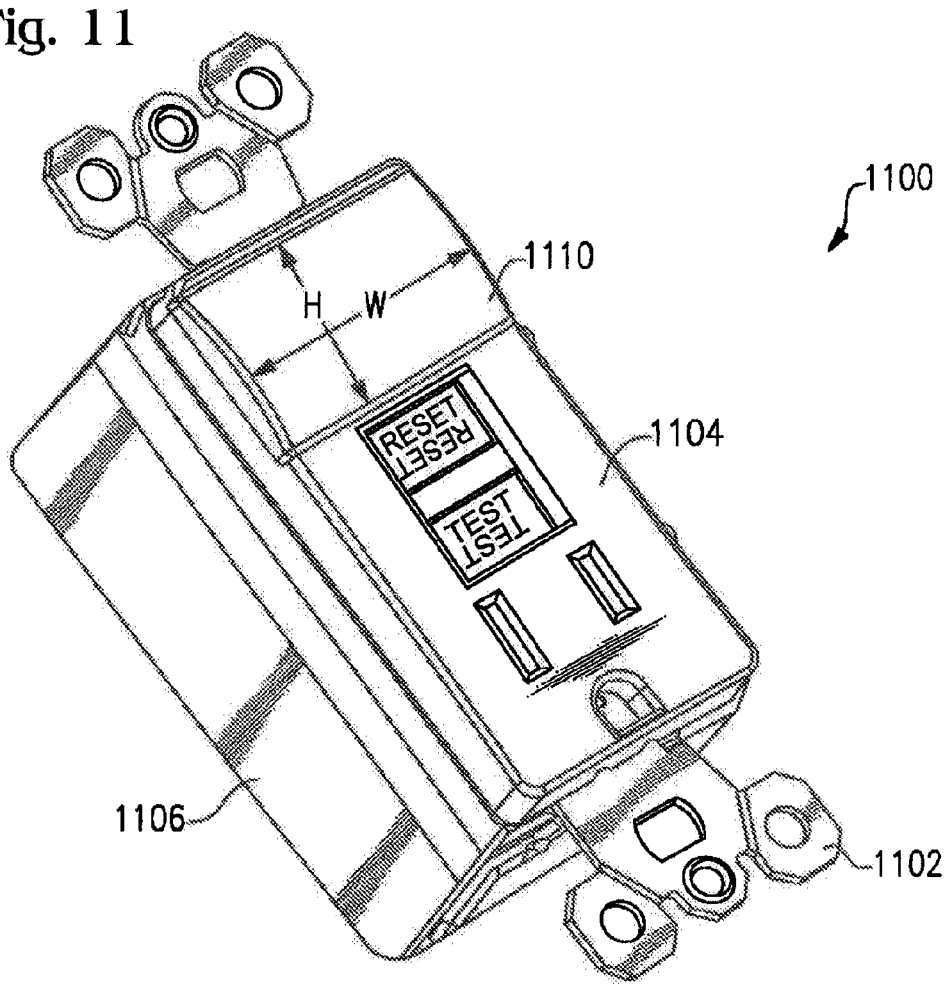
FIG. 11 is a perspective view of a GFCI/Light combination device in accordance with the present invention.

As embodied herein and depicted in FIG. 11, GFCl/Light combination device 1100 is disclosed. The electrical wiring device 1100 includes a cover member 1104 coupled to a rear body portion 1106. The form factor of rear body member 1106 is substantially identical to the rear portion 306 of the wiring device depicted in FIGS. 1-4. Wiring device 1100 includes a GFCI circuit of the type disclosed in FIGS. 1-8, and a light source disposed under lens cover 1110. This may be accomplished by disposing the light source(s) under lens cover on either side of strap member 1102. In an aspect of the embodiment, the light source disposed under lens cover 1110 functions as a pilot light by illuminating the ambient environment surrounding the electrical wiring device. The light source is connected to the line terminal elements in this embodiment. Accordingly, the light source is continuously energized as long as power is being provided to the device.

In another embodiment, the light source functions as a circuit status indicator and is connected to the load terminal elements. The light is, therefore, energized when device 1100 is in the reset state and the light is OFF when the device is tripped. The light source may be implemented using any suitable device, such as an LED. However, the light source may be implemented using a neon source, an incandescent source, etc.

The light source may be implemented using a single-element light source or a multi-element light source. For example, twin LEDs may be disposed under lens cover 1110. Those of ordinary skill in the art will understand that the wavelength of the illumination produced by the light source will depend on the type of source used, and may be selected as a function of the task being performed by the light source; e.g., a night-light, a status indicator, a room illuminator, etc.

Those of ordinary skill in the art will also understand that the lens cover 1110 may be made of a either a clear or a translucent material in accordance with design factors such as the type of light source, the wavelength radiated by the light source, the desired intensity, or softness, of the illumination, the function of the light, and other considerations. The lens cover 1110 may be removable from the housing cover 1104 for access to the light source.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A protective wiring device comprising:

a housing including a front cover member having a user-accessible front major surface and a back cover member having a back major surface arranged substantially in parallel with the front major surface, the user-accessible front major surface including at least one set of plug blade apertures configured to accept a set of plug blades from a corded plug, the back cover member including a power input receptacle formed at a first housing end, the power input receptacle being configured to receive a power input plug configured to be coupled to a source of AC power;

a set of receptacle terminals disposed within the front cover member, the set of receptacle terminals including a set of receptacle contacts that are accessible via the at least one set of plug blade apertures;

a power input assembly including a set of power input contacts disposed in the back cover member within the power input receptacle, the set of power input contacts being configured to mate with the power input plug when the power input plug is inserted into the power input receptacle, the set of power input contacts being connected to a plurality of conductive paths, the plurality of conductive paths being coupled to the set of receptacle terminals in a reset state and decoupled from the set of receptacle terminals in a tripped state; and a protective electrical circuit assembly including a toroidal sensor assembly coupled to the power input assembly, the protective electrical assembly further including a printed circuit board disposed adjacent the set of power input contacts in a plane substantially parallel to the back major surface, the printed circuit board including a fault detection circuit, a solenoid assembly, and at least a portion of a circuit interrupter mounted thereon, the set of power input contacts, the solenoid assembly and the toroidal sensor assembly being arranged within a plane disposed between the printed circuit board and the set of receptacle terminals.

2. The device of claim 1, further comprising a reset button assembly that includes a user accessible reset button disposed in the front cover and a reset mechanism coupled to the circuit interrupter, the reset button assembly being configured to effect the reset state in response to a user stimulus, the reset mechanism being disposed between the set of power input contacts, and the toroidal sensor assembly.

3. The device of claim 1, wherein the protective electrical circuit assembly includes an energy-efficient power supply that is configured to provide power to the protective electrical circuit assembly during all or a portion of a predetermined half cycle of a plurality of AC cycles.

4. The device of claim 1, further comprising a test button assembly disposed adjacent to a reset button assembly in the front cover, the test button being coupled to at least one test circuit coupled to the protective electrical circuit assembly.

5. The device of claim 1, wherein the protective wiring device includes no external terminal connection elements.

6. The device of claim 1, wherein the power input contacts are configured as blade structures.

7. The device of claim 1, wherein the protective electrical assembly further including a printed circuit board being substantially disposed between the set of power input contacts and the toroidal sensor assembly within the back cover member.

8. The device of claim 1, wherein the protective electrical circuit assembly is selected from a group of circuit assemblies that includes a GFCI, an AFCI, a transient voltage surge suppressor (TVSS), a sensor device, and/or an environmental regulation device.

9. The device of claim 1, wherein the circuit interrupter is configured to effect the tripped state in response to a fault detect signal provided by the fault detection circuit.

10. The device of claim 9, wherein the fault detect signal is indicative of a ground fault, an arc fault or a transient voltage surge.

11. The device of claim 1, wherein the housing further includes an electrically isolating separator member disposed between the front cover member and the back cover member such that a front interior region is formed between the front cover member and the electrically isolating separator member and a rear interior region is formed between the back cover member and the electrically isolating member.

12. The device of claim 11, further comprising a ground strap having an interior ground strap portion disposed on the electrically isolating member in the front interior region, the ground strap being connected to a ground blade of the set of power input contacts.

13. The device of claim 1, wherein the circuit interrupter includes a hot cantilevered circuit interrupter structure disposed on a first longitudinal side of the solenoid assembly and connected to a hot conductive path of the plurality of conductive paths, and wherein the circuit interrupter includes a neutral cantilevered circuit interrupter structure disposed on a second longitudinal side of the solenoid assembly and connected to a neutral conductive path of the plurality of conductive paths.

14. The device of claim 13, wherein the hot cantilevered circuit interrupter structure is coupled to the hot conductive path and the neutral cantilevered circuit interrupter structure is coupled to the neutral conductive path via the toroidal sensor assembly.

15. The device of claim 14, wherein the hot conductive path includes a hot wire conductor disposed between a hot blade of the set of power input contacts and the toroidal sensor assembly and the neutral conductive path includes a neutral wire conductor disposed between a neutral blade of the set of power input contacts and the toroidal sensor assembly.

16. The device of claim 1, further comprising an end-of-life circuit element configured to decouple the fault detection circuit from the plurality of conductive paths in response to an end-of-life condition.

17. The device of claim 16, wherein the end-of-life circuit element includes an auxiliary switch coupled between the solenoid assembly and the fault detection circuit.

18. The device of claim 1, wherein the protective electrical circuit assembly includes a light indication circuit.

19. The device of claim 18, wherein the light indication circuit includes at least one LED disposed on the printed circuit board and at least one light pipe disposed between the at least one LED and at least one aperture formed in the front cover member.

20. The device of claim 18, wherein the at least one set of plug blade apertures is disposed substantially adjacent to a lens element in the user-accessible front major surface opposite, the lens element being configured to cover a light emitting element connected to the light indication circuit.

21. The device of claim 20, further comprising a reset button and a test button substantially disposed adjacent the lens element.

22. The device of claim 20, wherein the user accessible front major surface is characterized by a longitudinal axis and a latitudinal axis, the lens element including a first dimension parallel to the latitudinal axis and a second dimension parallel to the longitudinal axis, and wherein the first dimension or the second dimension is disposed along an edge of the user accessible front major surface.

23. The device of claim 22, wherein the first dimension is substantially equal to a width of the user accessible front major surface.

24. A protective wiring device comprising:

a housing including a front cover member having a front major surface and a back cover member having a back major surface arranged substantially in parallel with the front major surface, the housing further including an electrically isolating separator member disposed between the front cover member and the back cover member such that a front interior region is formed between the front cover member and the electrically isolating separator member and a rear interior region is formed between the back cover member and the electrically isolating member, the front major surface including at least one set of plug blade apertures configured to accept a set of plug blades from a corded plug, the back cover member including a power input receptacle formed at a first housing end, the power input receptacle being configured to receive a power input plug configured to be coupled to a source of AC power such that the protective wiring device includes no external terminal connection elements;

a set of receptacle terminals disposed in the electrically isolating separator member within the first interior region, the set of receptacle terminals including a set of receptacle contacts that are accessible via the at least one set of plug blade apertures;

a power input assembly including a set of power input contacts disposed in the rear interior region within the power input receptacle, the set of power input contacts being configured to mate with the power input plug when the power input plug is inserted into the power input receptacle, the set of power input contacts being connected to a plurality of conductive paths, the plurality of conductive paths being coupled to the set of receptacle terminals in a reset state and decoupled from the set of receptacle terminals in a tripped state;

a protective electrical assembly substantially disposed in the rear interior region and coupled to the power input assembly, the protective electrical assembly including a toroidal sensor assembly, a fault detection circuit, a solenoid assembly, and a circuit interrupter, the toroidal sensor assembly and the solenoid assembly being disposed in the rear interior region portion at a second housing end opposite the first housing end, the circuit interrupter being configured to effect the tripped state in response to a fault detect signal provided by the fault detection circuit; and a reset button assembly including a user accessible reset button disposed in the front cover and a reset mechanism coupled to the circuit interrupter, the reset button assembly being configured to effect the reset state in response to a user stimulus, the reset mechanism being disposed between the set of power input contacts, and the toroidal sensor assembly and the solenoid assembly.

25. The device of claim 24, further including a ground strap having an interior ground strap portion disposed on the electrically isolating member in the front interior region.

26. The device of claim 24, wherein the protective electrical circuit assembly is selected from a group of circuit assemblies that includes a GFCI, an AFCI, a transient voltage surge suppressor (TVSS), a sensor device, and/or an environmental regulation device.

27. The device of claim 24, wherein the circuit interrupter includes a hot cantilevered circuit interrupter structure disposed on a first longitudinal side of the solenoid assembly and connected to a hot conductive path of the plurality of conductive paths, and wherein the circuit interrupter includes a neutral cantilevered circuit interrupter structure disposed on a second longitudinal side of the solenoid assembly and connected to a neutral conductive path of the plurality of conductive paths.

28. The device of claim 27, wherein the hot cantilevered circuit interrupter structure is coupled to the hot conductive path and the neutral cantilevered circuit interrupter structure is coupled to the neutral conductive path via the toroidal sensor assembly.

29. The device of claim 28, wherein the hot conductive path includes a hot wire conductor disposed between a hot blade of the set of power input contacts and the toroidal sensor assembly and the hot neutral conductive path includes a neutral wire conductor disposed between a neutral blade of the set of power input contacts and the toroidal sensor assembly.

30. An electrical wiring system for use in an electrical distribution system including at least one electric circuit, the at least one electric circuit including a plurality of electric power transmitting wires disposed between an electric power distribution point and a device box disposed at an electrical device location, the device box having a wiring ingress aperture, an interior device box volume and an open side, the plurality of electric power transmitting wires being routed through the wiring ingress aperture and accessible at the open side after a rough-in phase of installation, the system comprising:

a power input plug assembly including a plurality of plug connector contacts disposed within a power input plug housing, the power input plug assembly including a termination interface configured to terminate the plurality of electrical power transmitting wires such that electrical continuity is established between the plurality of plug connector contacts and the electric power distribution point; and a protective wiring device comprising, a housing including a front cover member having a front major surface and a back cover member having a back major surface arranged substantially in parallel with the front major surface, the front major surface including at least one set of plug blade apertures configured to accept a set of plug blades from a corded plug, the back cover member including a power input receptacle formed at a first housing end, the power input receptacle being configured to receive the power input plug housing configured to be coupled to a source of AC power such that the protective wiring device includes no external terminal connection elements, a set of receptacle terminals disposed within the front cover member, the set of receptacle terminals including a set of receptacle contacts that are accessible via the at least one set of plug blade apertures, a power input assembly including a set of power input contacts disposed in the back cover member within the power input receptacle, the set of power input contacts being configured to be coupled to the plurality of plug connector contacts when the power input plug housing is inserted into the power input receptacle, the set of power input contacts being further connected to a plurality of conductive paths, the plurality of conductive paths being coupled to the set of receptacle terminals in a reset state and decoupled from the set of receptacle terminals in a tripped state, and a protective electrical circuit assembly including a toroidal sensor assembly coupled to the power input assembly, the protective electrical assembly further including a printed circuit board disposed adjacent the set of power input contacts in a plane substantially parallel to the back major surface, the printed circuit board including a fault detection circuit, a solenoid assembly, and at least a portion of a circuit interrupter mounted thereon, the set of power input contacts, the solenoid assembly and the toroidal sensor assembly being arranged within a plane disposed between the printed circuit board and the set of receptacle terminals.

31. The system of claim 30, wherein the power input plug assembly further comprises:

a first housing portion;

a second housing portion configured to mate with the first housing portion to thereby form the power input plug housing; and a plurality of contacts including blade elements, the plurality of contacts being disposed in either the first housing portion or the second housing portion or both, the blade elements being configured to displace insulation disposed on the plurality of wires when the second housing portion is coupled to the first housing portion, whereby electrical continuity is established between each wire and a corresponding one of the plurality of contacts.

32. The system of claim 30, further comprising a latch member disposed on the power input plug assembly, the latch member being configured to engage a latching portion of the power input receptacle to latch the power input plug assembly within the power input receptacle.

33. The system of claim 30, wherein the power input plug assembly includes female electrical contacts substantially inaccessible to a user such that the power input plug assembly is safely removable from the protective wiring device when energized.

34. The system of claim 30, wherein the power input plug assembly may be safely inserted into a second electrical wiring device when energized to thereby provide power to the second electrical wiring device.

35. The system of claim 30, wherein the printed circuit board is substantially disposed between the set of power input contacts and the toroidal sensor assembly within the back cover member.

36. The system of claim 30, wherein the power input plug housing includes a first housing portion and a second housing portion, the second housing portion extending from the first housing portion in a substantially orthogonal direction.

37. The system of claim 36, wherein the first housing portion is configured to be inserted into the power input receptacle, and wherein the second housing portion is disposed adjacent the back major surface when the first housing portion is inserted into the power input receptacle.

38. A method for installing an electrical wiring device within an electrical distribution circuit, the electrical distribution circuit including a plurality of electrical conductors coupled to a source of electrical power, the method comprising:

providing a power input plug including a plurality of conductive elements;

providing a protective wiring device comprising, a housing including a front cover member having a front major surface and a back cover member having a back major surface arranged substantially in parallel with the front major surface, the front major surface including at least one set of plug blade apertures configured to accept a set of plug blades from a corded plug, the back cover including a power input receptacle formed at a first housing end, the power input receptacle being configured to receive the power input plug, a set of receptacle terminals disposed within the front cover member, the set of receptacle terminals including a set of receptacle contacts that are accessible via the at least one set of plug blade apertures, a power input assembly including a set of power input contacts disposed in the back cover member within the power input receptacle, the set of power input contacts being configured to mate with the power input plug when the power input plug is inserted into the power input receptacle, the set of power input contacts being connected to a plurality of conductive paths, the plurality of conductive paths being coupled to the set of receptacle terminals in a reset state and decoupled from the set of receptacle terminals in a tripped state, and a protective electrical circuit assembly including a toroidal sensor assembly coupled to the power input assembly, the protective electrical assembly further including a printed circuit board disposed adjacent the set of power input contacts in a plane substantially parallel to the back major surface, the printed circuit board including a fault detection circuit, a solenoid assembly, and at least a portion of a circuit interrupter mounted thereon, the set of power input contacts, the solenoid assembly and the toroidal sensor assembly being arranged within a plane disposed between the printed circuit board and the set of receptacle terminals;

connecting the plurality of conductive elements to the plurality of electrical conductors; and inserting the power input plug into the power input receptacle to establish electrical continuity between the plurality of conductive paths and the plurality of conductive elements.

39. The method of claim 38, wherein the protective wiring device includes no external terminal connection elements.

40. The method of claim 38, wherein the printed circuit board is substantially disposed between the set of power input contacts and the toroidal sensor assembly within the back cover member.

41. The method of claim 38, wherein the protective electrical circuit assembly is selected from a group of circuit assemblies that includes a GFCI, an AFCI, a transient voltage surge suppressor (TVSS), a sensor device, and/or an environmental regulation device.

* * * * *